US007472514B2

(12) United States Patent
Blomqvist

(10) Patent No.: US 7,472,514 B2
(45) Date of Patent: Jan. 6, 2009

(54) WINDOW, DOOR OR THE LIKE COMPRISING A SWINGING ARMS ASSEMBLY WITH STOP MEANS

(75) Inventor: Torbjörn Blomqvist, Lammhult (SE)

(73) Assignee: Steelform Scandianavia AB, Lammhult (SE)

( * ) Notice: Subject to any disclaimer, the term of this patent is extended or adjusted under 35 U.S.C. 154(b) by 503 days.

(21) Appl. No.: 10/568,663

(22) PCT Filed: Aug. 11, 2004

(86) PCT No.: PCT/SE2004/001180

§ 371 (c)(1),
(2), (4) Date: Feb. 16, 2006

(87) PCT Pub. No.: WO2005/017295

PCT Pub. Date: Feb. 24, 2005

(65) Prior Publication Data

US 2006/0218864 A1 Oct. 5, 2006

(30) Foreign Application Priority Data

Aug. 19, 2003 (SE) ..... 0302242

(51) Int. Cl.
*E05F 11/28* (2006.01)

(52) U.S. Cl. ..... 49/345; 49/239; 49/394; 16/362; 16/366

(58) Field of Classification Search ..... 49/381, 49/394, 339, 345, 346, 322; 16/362, 366, 16/371

See application file for complete search history.

(56) References Cited

U.S. PATENT DOCUMENTS

| | | | | | |
|---|---|---|---|---|---|
| 3,994,095 | A | * | 11/1976 | Hare | 49/356 |
| 4,620,393 | A | * | 11/1986 | Stafset | 49/394 |
| 4,807,914 | A | * | 2/1989 | Fleming et al. | 292/48 |
| 5,193,249 | A | * | 3/1993 | Bucher | 16/371 |

(Continued)

FOREIGN PATENT DOCUMENTS

| | | |
|---|---|---|
| NO | 179804 | 12/1996 |

(Continued)

*Primary Examiner*—Katherine W Mitchell
*Assistant Examiner*—Catherine A Kelly
(74) *Attorney, Agent, or Firm*—Davis & Bujold, P.L.L.C.

(57) ABSTRACT

The present invention relates to a window, comprising a case (2) and a frame (4), swingably fastened in the case by a swinging arm assembly (3). The assembly has a base plate (5), fastened to a case side piece, one end of an upper swinging arm (6) being flexibly fastened at the top of the base plate and one end of a lower swinging arm (7) being fastened at the bottom of the base in a similar way. The other ends of the arms are flexibly fastened to the top of a frame plate (8), the lower end of which supports a swinging axle (9), to be inserted into the respective side piece of the frame. Releasable locking elements are mounted between the frame and the case as well as the assembly parts, which belong thereto, respectively for a swinging limitation of the frame in relation to the case, which limitation can be cancelled. According to the invention the blocking elements are mounted adjacent the swinging center of the frame, partly at the frame plate (8) and partly at the base plate (5). At least one of the stop mechanism parts can be drawn out and be inserted respectively in a telescopic way.

9 Claims, 10 Drawing Sheets

U.S. PATENT DOCUMENTS 5,323,568 A * 6/1994 Blomqvist ..... 49/248
5,557,829 A * 9/1996 Schoen et al. ..... 16/375
5,588,259 A * 12/1996 Kolefas ..... 49/394
5,983,569 A * 11/1999 Karlsson ..... 49/354
6,397,434 B1 * 6/2002 Cheal et al. ..... 16/370
6,618,995 B2 * 9/2003 De Marco ..... 49/248
6,880,792 B2 * 4/2005 Muir ..... 248/276.1

FOREIGN PATENT DOCUMENTS

SE 464 482 4/1991
WO WO 03/021066 3/2003

* cited by examiner

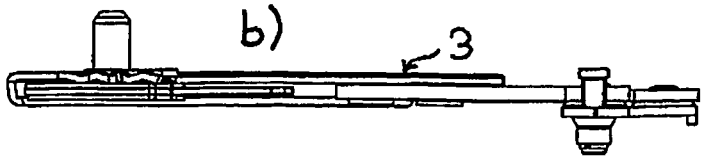
Fig. 8
Fig. 9
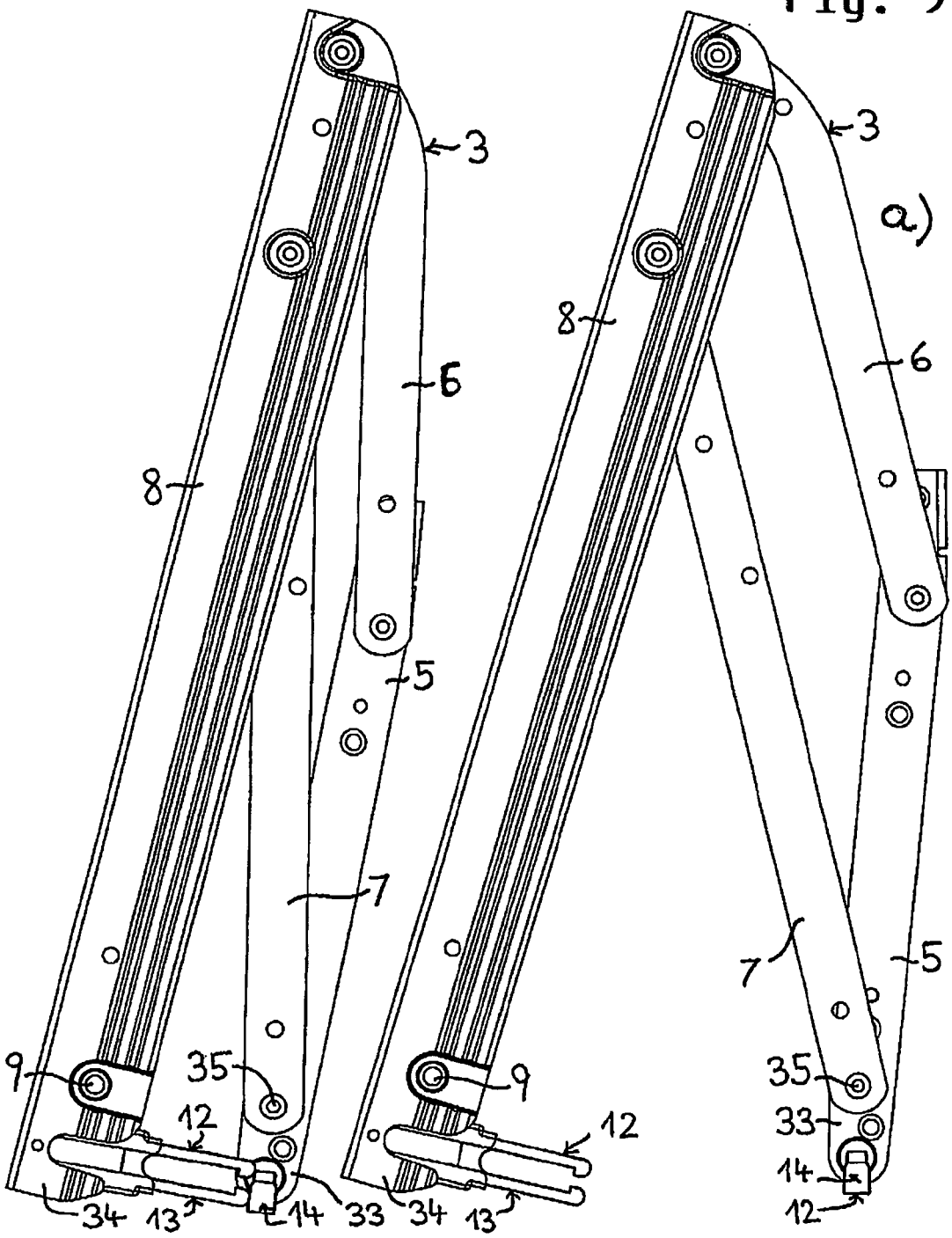

WINDOW, DOOR OR THE LIKE COMPRISING A SWINGING ARMS ASSEMBLY WITH STOP MEANS

This application is a national stage completion of PCT/SE2004/001180 filed Aug. 11, 2004 which claims priority from Swedish Application Serial No. 0302242-3 filed Aug. 19, 2003.

FIELD OF THE INVENTION

The present invention relates to a window, a door or the like comprising a swinging arm assembly with stop means, of the type set forth in the preamble of claim 1.

BACKGROUND OF THE INVENTION

A swinging arm assembly, comprising stop means, already is known through e.g. SE B 464 482. By means of such an assembly a window frame can be swung from a closed position to a partially opened up position, in which stop means start to function to stop the swinging movement from moving on to a larger opening angle. The object of this stop action is primarily to prevent children from falling out of the window. However, during window cleaning, painting etc. it is desirable to be able to open the window further or actually turn the frame around half a rotation, which is done by a manual actuation of the stop means, these stop means leaving their engagement position with said assembly, the frame then being able to be swung and possibly again to be locked in relation to the case and the assembly after a swinging motion of half a rotation, i.e. a locking of the window must be possible, also when the frame has been turned about 180°.

Such stop means work in principle in a satisfactory way. However, in an assembly comprising such stop means a relatively large exchange of power takes place, i.e. typically in the order of magnitude of 1:5-1:20, i.e. a power, applied on the lower part of the frame, when the window is partially opened up, will be multiplied up to 20 times, when the frame reaches the stop means. The calculations for two assemblies, now being sold, have shown, that the force, which the stop means are subjected to, will be about 8 and 3.5 respectively times the force, directed outwards on the lower frame edge. Consequently, the stop means as well as the assembly have of necessity been dimensioned considering these conditions, which has resulted in larger dimensions, higher consumption of material and other considerations. Nevertheless, it has not been possible to avoid a tendency to marked elasticity. One aggravating circumstance resides in the fact, that the construction of the stop means is such, that the mounting will be done on only one case side, since the frame ought to be swung a small distance outwards simultaneously with the opening of the stop means, which quite likely cannot be done by just one person on the two case sides at the same time. However, in case one stop means will be applied only on one case side, a load on the frame on the other case side, particularly within the bottom area of the frame, will allow a development of elasticity forces in the frame, since there are on said other case side no stop means braking and checking these forces and the forces on the other case side may be active all the way up to the upper fastening of the frame, since it is necessary to allow for the weakness of the frame, particularly if the windows are relatively wide. Consequently, it will be difficult, regarding such already known constructions, to, especially on the frame side turned away from the stop means, limit the ventilation gap to e.g. not wider than 100 mm for a certain predetermined load.

Another drawback may reside in the fact, that a child may see and learn, how stop means are opened up. In case there is only one stop means, the results may become disastrous. Another drawback may be, that the stop means are applied in an area, where it is possible to have one's fingers caught, which of course is a much greater risk for children. There is also certainly a distant but nevertheless not negligible risk, that the stop means stop functioning in the intended way, particularly after they have been used for a long time, resulting in difficulty closing the window. In case these correct controls are not forthcoming, the locking functioning and/or the functions of the frame will be jeopardized.

It is e.g. objectionable to use such control elements as the force of gravity and/or springs and/or certain prescribed mounting positions. Finally, certain drawbacks may arise, in case the stop means are applied within an assembly, which already, because of its construction, requires a substantial space. In case this space must be increased because of the stop means, certain extraordinary steps might have to be taken to limit the space necessary for the stop means and its functioning.

SUMMARY OF THE INVENTION

The object of the present invention is to counter-act as far as possible and preferably eliminate the above-mentioned drawbacks. Another object of the invention is to further develop the state of the art in this technical field in additional respects.

These objects are attained according to the invention by designing a window, a door or the like, comprising a swinging arm assembly with stop means, of the type described in the introduction, in such a way, as mainly is set forth in the characterizing clause of claim 1. Calculations have shown, that the force, which the stop means of an assembly according to the invention is subjected to, will be only about 2 times the outwardly directed force on the lower frame edge. Also, the arms of the assembly will not be subjected to these forces, but the forces will act only between the outer assembly arm and the case plate via the stop means. In already known solutions the forces in the stop means are active between the case plate and the lower assembly arm and are exchanged with a leverage in the lower assembly arm and with an additional leverage in the outer arm.

BRIEF DESCRIPTION OF THE DRAWINGS

Additional characterizing features and advantages of the invention will be set forth in the following description, reference being made to the accompanying drawings, which show a few preferred but only exemplifying embodiments. The drawings show in detail:

FIG. 8 a lateral view of the assembly according to FIG. 4 in a somewhat higher opened up-position than the ventilation position;

FIGS. 9*a* and *b* a lateral and an end view respectively of the assembly according to FIG. 4 in a higher opened-up position;

DETAILED DESCRIPTION OF THE INVENTION

Figure 1:
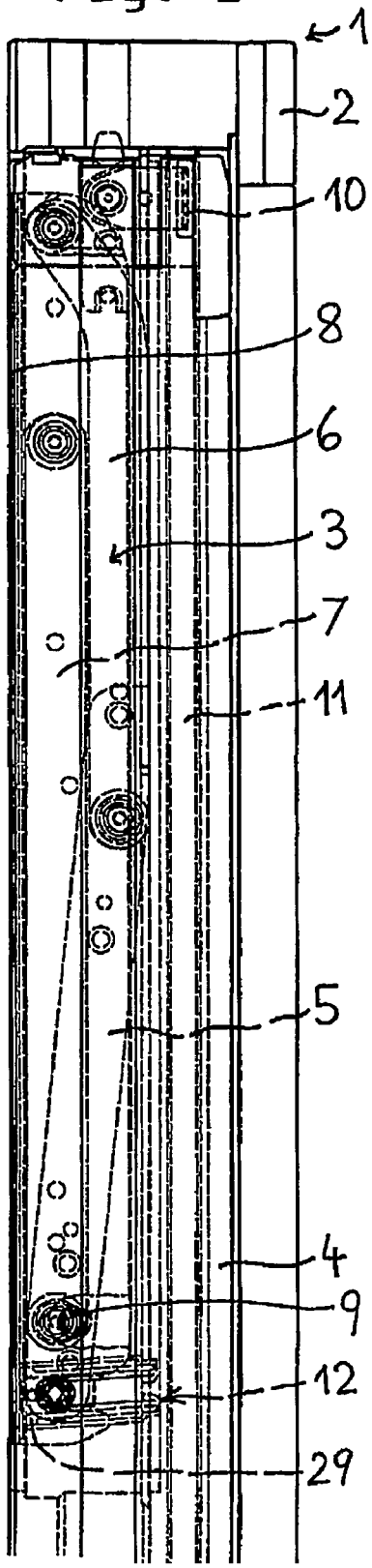
FIG. 1 the upper part of a window frame, inserted into a case with an assembly according to the invention, the frame being closed.
Figure 2:
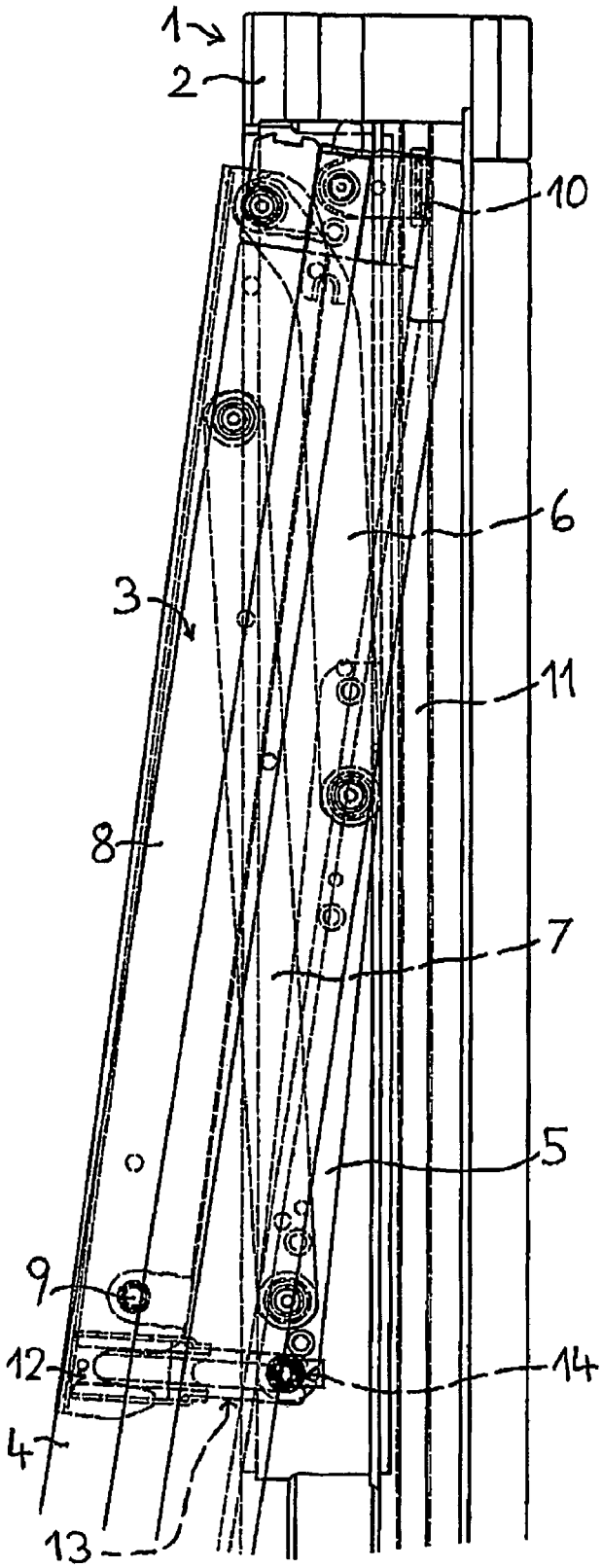
FIG. 2 the assembly according to FIG. 1, with the frame in a ventilation position.

In the drawings the same or similar parts have the same reference numerals. Thus, a window, a door or the like, designated 1 in its entirety, comprising a case 2, in which, by means of a swinging arm assembly 3, according to the invention, a window-frame 4 is swingably fastened, which in a known way can be swung 180°, when the window e.g. is to be cleaned.

Swinging arm assembly 3 comprises a base plate 5, fastened in a case piece side, within its upper section on its inner side, at which at the top of it the one end of an upper swinging arm 6 is articulately fastened and at the bottom of it in the same way the one end of a lower swinging arm 7. The other ends of these swinging arms are articulately fastened at their upper parts to a frame plate 8, the lower end of which carries a swinging axle 9 to be inserted into a respective side piece of the frame, which at its top is provided with a sliding mounting 10, which is guided in a longitudinal groove 11 in said vertical case piece. Suitably two swinging arm assemblies and two sliding mountings are provided, one on each side between the side pieces of the case and the frame respectively. All important assembly parts suitably are made of metal. Also, the lower end of the frame is provided with a handle (not shown), designed to be used to shut the window at the lower end of the case.

Such a frame can as a rule be swung 180° in order to facilitate a cleaning, a painting etc. However, it is not desirable, that such a swinging movement be carried out without obstructions, e.g. by children. Thus, stop means, designated 12 in their entirety, are mounted adjacent the swinging centre of the frame, preferably one stop means at each side of the window. One stop means part 13 is mounted at a side piece of the frame and another stop means part 14 at the adjacent side piece of the case. The stop means can in principle be fastened to the frame and the case respectively, but this is considered less suitable than a combination with the swinging arm assembly, in which the lower end of frame plate 8 can be provided with said one stop means part 13, whereas the lower end of base plate 5 can be provided with said second stop means part 14. Where appropriate, said plates can downwards form extensions 33 and 34 respectively beyond the swinging axle 9 and the free axle 35 of the lower swinging arm respectively, in order to house and support respectively said stop means parts. The latter may, if this is desirable, also change places in relation to what is shown in the drawings.

Frame plate 8 carries, with its preferably beyond swinging axle 9 downwardly extended part 34, said first stop means part 13 and also suitably is itself designed as a part of the same. A considerable portion of stop means part 13 is a guide groove 16, open towards the other stop means part 14, orifice 17 of which being constricted by means of claws 18, facing each other, the outside of which consists of guiding surfaces 19 for said second stop means part, e.g. designed as bends, whereas the interior sides 20 of the claws mainly are perpendicular to the guide groove in order to form arresting means for said second stop means part. Guide groove 16 is located within the plane of the frame plate or within a plane, which is plane-parallel with the frame plate. Stop means part 13 is located at least mainly within the plane of the swinging arms and consequently does not occupy any additional space cross-wise along the swinging arm assembly. Stop means part 14 is located mainly within the planes of the swinging arms and the frame plate 8 and consequently also do not occupy any additional space cross-wise along the swinging arm assembly.

According to a preferred embodiment, which is shown in the drawings, first stop means part 13 is telescopically designed in order to enhance its active length. To this end web 15 of a holding element 21, having a C-shaped profile, in fastened to the side of the frame plate, which faces base plate 5, e.g. by means of screws, riveting or welding 22, with a section 24. Said web includes a guiding groove 23, which in the closing position of the assembly is at least mainly congruent with said guiding groove and thus is split in addition to said section 24, which is located at the very end opposite the other stop means part and which may be the only or main fastening zone, if appropriate a limited bending around a screw, a rivet or the like 22 being allowed. Groove-like longitudinal sides 25 of holding element 21 hold and guide a runner 26, which in its inserted position at the far end abuts a stop element, e.g. a leg 27 with an angle from frame plate 8 towards the adjacent case side piece. In the other direction runner 26 is stopped from being drawn out of the holding element by means of stop means, e.g. towards sections 28, pressed against each other, of said groove-like longitudinal sides. These sections arrest the displacement of the runner towards the other stop means part 14, because the runner is provided with ears 29, which mutually project in opposite directions and are guided in groove-like longitudinal sides 25 and which ears thus abut sections 28 in the location at the far end of the runner. The runner has a plate-like shape and for the rest the shape, which is described in the introduction, with a guiding groove, claws facing each other and a section, located in the remotest location away from the other stop means part, from which said ears project but which of course is not fastened to the frame plate. Whereas the ears of the runner are guided by means of longitudinal sides 25 with a satisfactory slip fit, longitudinal sides 31 of the runner are solely or mainly guided by means of said section 28, designed as a restriction. Finally, also the frame plate is provided with a guiding groove 32, which is congruent in relation to the two guiding grooves mentioned above, i.e. which is super-imposed on the guiding groove of the holding element. In this way three different guiding grooves are obtained, superimposed on each other in the closing direction of the assembly.

The other stop means part 14 includes a pivot 36, which preferably is mounted in the extension of the base plate in a stationary housing 37, which extends through said extension and projects a small distance from the case side of the extension, the housing with its projecting part being inserted into and fastened to, e.g. by means of a press fit, a blind hole (not shown) in the case. The pivot is inserted into the housing in a friction-controlled and removal-secure way, e.g. by providing the housing and/or the pivot with one or several grooves 38, 39 and 40 respectively, housing an O-ring 41 and a circlip 42 respectively.

Figure 14:
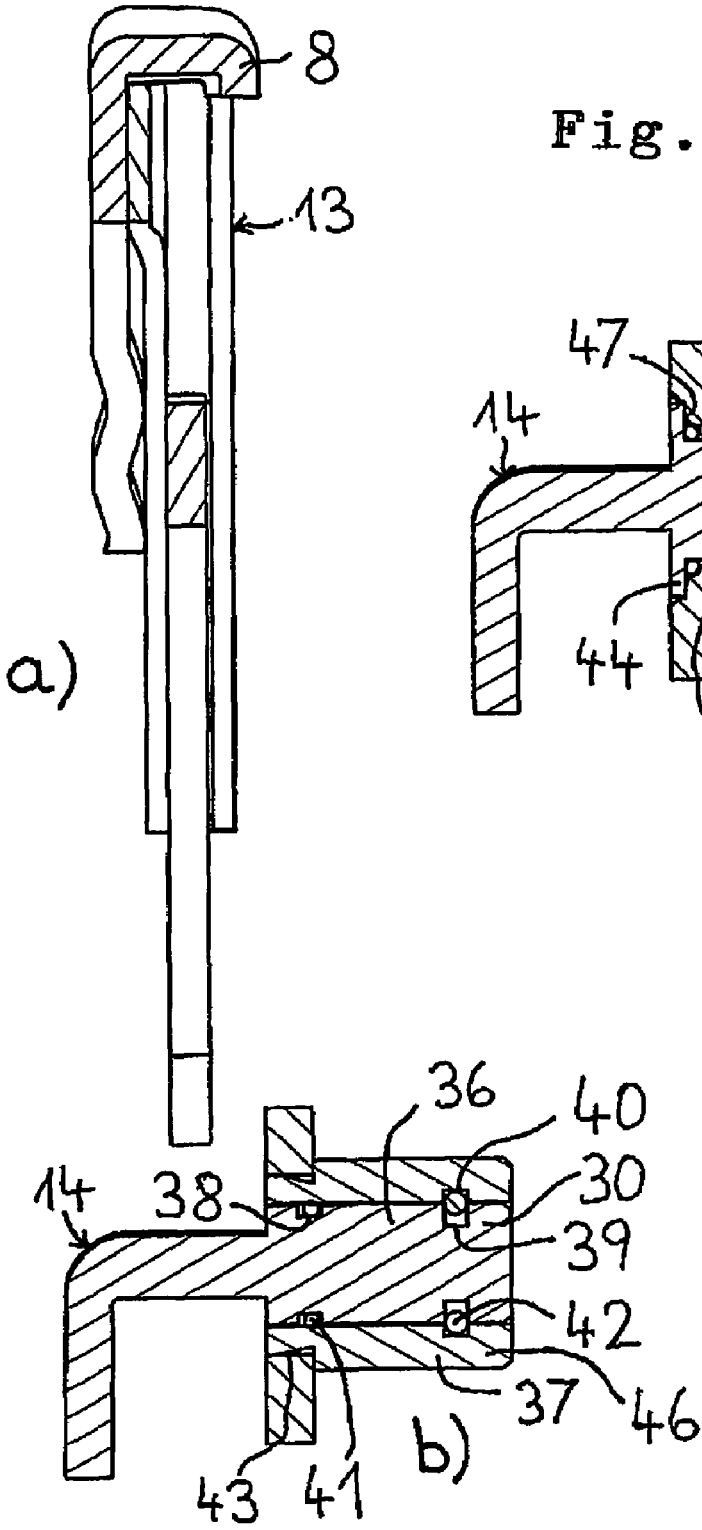
FIGS. 14*a* and *b* diametrical section views of assembly and stop means parts according to FIG. 12.

In the embodiment shown in FIG. 14 the housing and the rivet have the same length and house in grooves 39 and 40 respectively, facing each other, in rivet base 30 and housing base 46 respectively a circlip 42, whereas a groove 38 in the rivet base houses an O-ring 41, compressed between the groove and the housing, friction being generated in this way. The housing is anchored through an upsetting with the material around a bore of the like 43 in the extension of the case plate.

Figure 15:
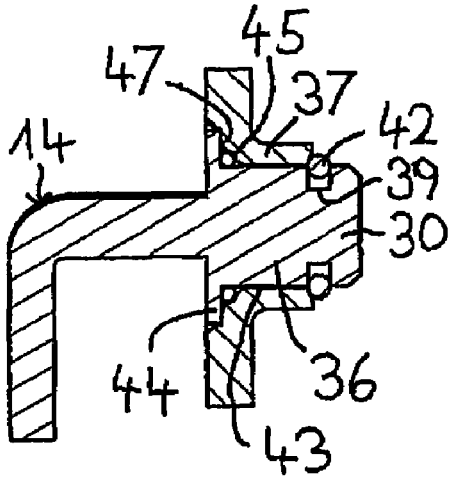
FIG. 15 a view, which corresponds to FIG. 14*b,* of a modified pivot design.

In the embodiment, shown in FIG. 15, rivet base 30 extends over the end of the housing, which faces the extension, and is here provided with a groove 39 for a circlip 42. At its other end the rivet has a flange 44, between which and the rivet body, which for the rest is cylindrical, as well as a bevel 45 in the housing an O-ring 41 is inserted during compression and consequently also a friction generated. The housing, which is somewhat shorter in this case, is obtained through an upsetting outwards of material from the extension, also an annular groove 47 being formed, designed to receive flange 44.

From the rivet body a stop element 48 with a multiple function extends towards stop means part 13. Shoulder 48 of the stop element has in a certain rotational position a stop function and in another position, e.g. 90° clockwise or counter-clockwise in relation to said rotational position, a release function. This is achieved, preferably by designing the shoulder part as a plate, the width of the cross-sectional shape of which being twice as large as its thickness. In this way the thickness can pass through claws 18 but not the width, which mainly fills the width of the guiding groove and brings along, during a displacement, the runner by moving it along its interior sides 20. Finally, guiding portion 49 of the stop element is bent at right angles in relation to the shoulder part around these wide sides and is designed as a lug, projecting in one direction, its sides 50 suitably diverging from the shoulder portion in order to facilitate an insertion, to be described below. Guiding portion 49 is wider than guiding groove 16, preventing the guiding portion from passing through the guiding groove in a cross-wise direction. Guiding groove 32 of the frame plate diverges outwards, at least within the area of the orifice, which is designed with softly rounded stop faces 51.

Figure 4:
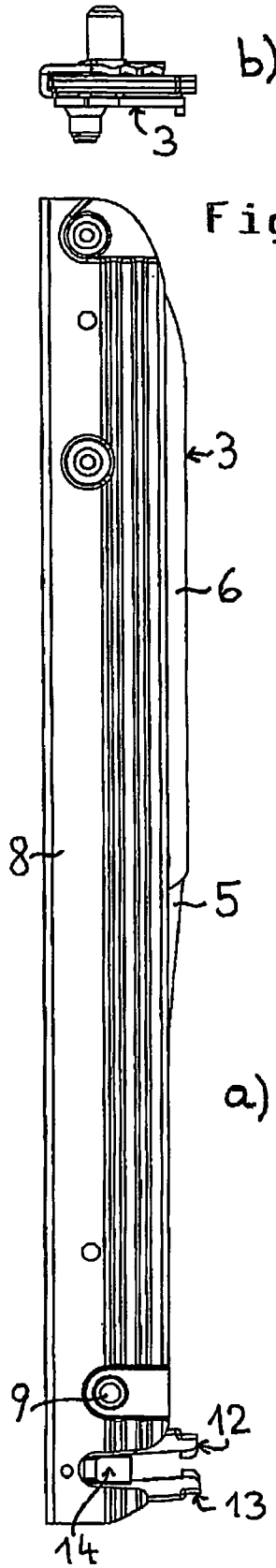
FIG. 4*a-c* a lateral and an end and a front view respectively of the assembly according to FIG. 1 in the closing position.

A swinging arm assembly, designed in this way, functions in the following way:

FIG. 4 represents the closing position of the window or the like. The runner is completely inserted into the holder and the guiding portion 49 occupies its principal stop position with the plate positioned cross-wise and with the lug forcibly guided into the innermost portion of the guiding groove of the frame plate.

Figure 5:
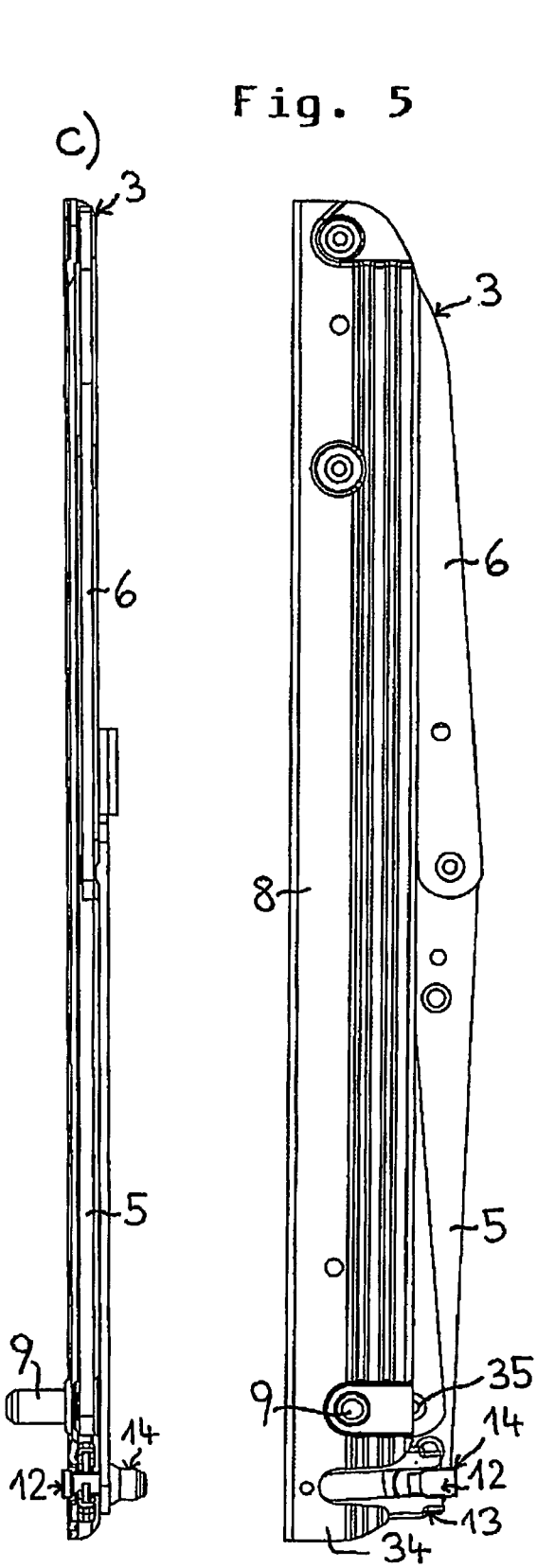
FIG. 5 a lateral view of the assembly according to FIG. 4., in an open position between the closing position and the ventilation position.

FIG. 5 shows the swinging arm assembly subsequent to an initial movement of the frame roughly half-way between the closing and the ventilation position. The runner has not been moved so far, but the guiding portion, with its plate-shaped shoulder, has hit the interior sides of the claws.

Figure 6:
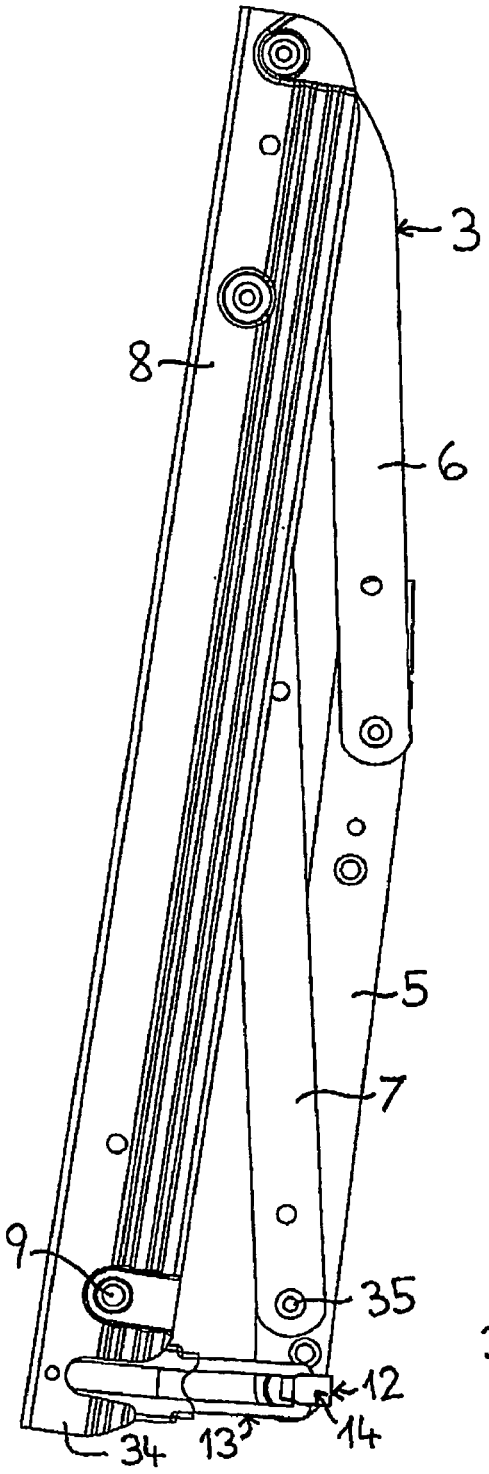
FIG. 6*a* a lateral view of the assembly according to FIG. 4 in a locked ventilation position.
Figure 6:
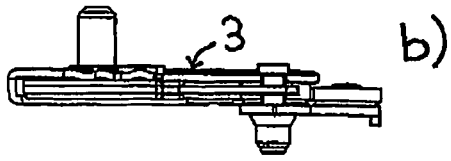

FIG. 6 represents the ventilation position of the frame, which also can be stopped in this position through means, known per se, e.g. a locking arm (not shown), mounted at the bottom of the lower swinging arm, said locking arm being allowed to be swung and, roughly at right angles, hit leg 27 of the frame plate. In this position the runner has been maximally drawn out of the holder and is held, with the interior sides of its claws, against the plate-shaped shoulder of the guiding portion.

Figure 7:
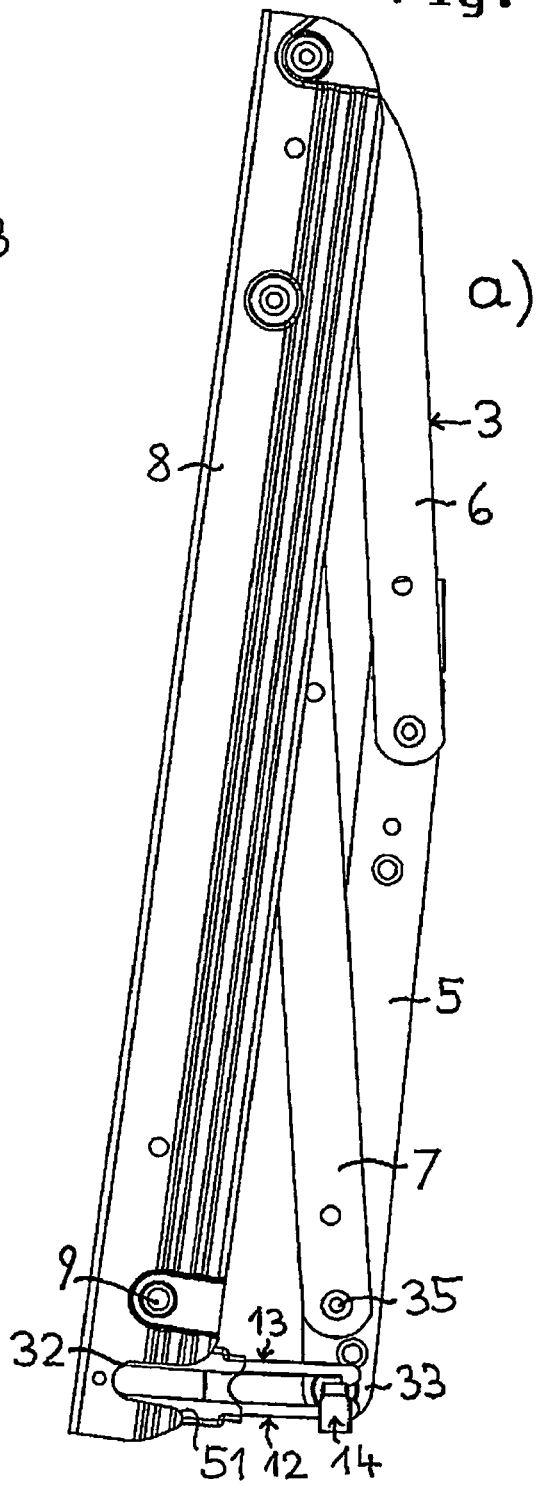
FIGS. 7*a* and *b* a lateral and an end view respectively of the assembly according to FIG. 4 in a not locked ventilation position.

FIG. 7 corresponds to FIG. 6, but the guiding portion has been swung with an angle of 90° downwards or upwards, manually and against the action of the built-in controlled friction, the plate-shaped shoulder being exposed with a narrow side to orifice 17 and then being able to pass out of it in order to completely release the frame and allow its maximal swinging with about 180° or more.

FIG. 8 shows, that stop means part 13 right now has left the engagement with stop means part 14. From now on the position of stop means part 14 will not be changed due to friction, in particularly the friction, generated by O-ring 41.

Figure 3:
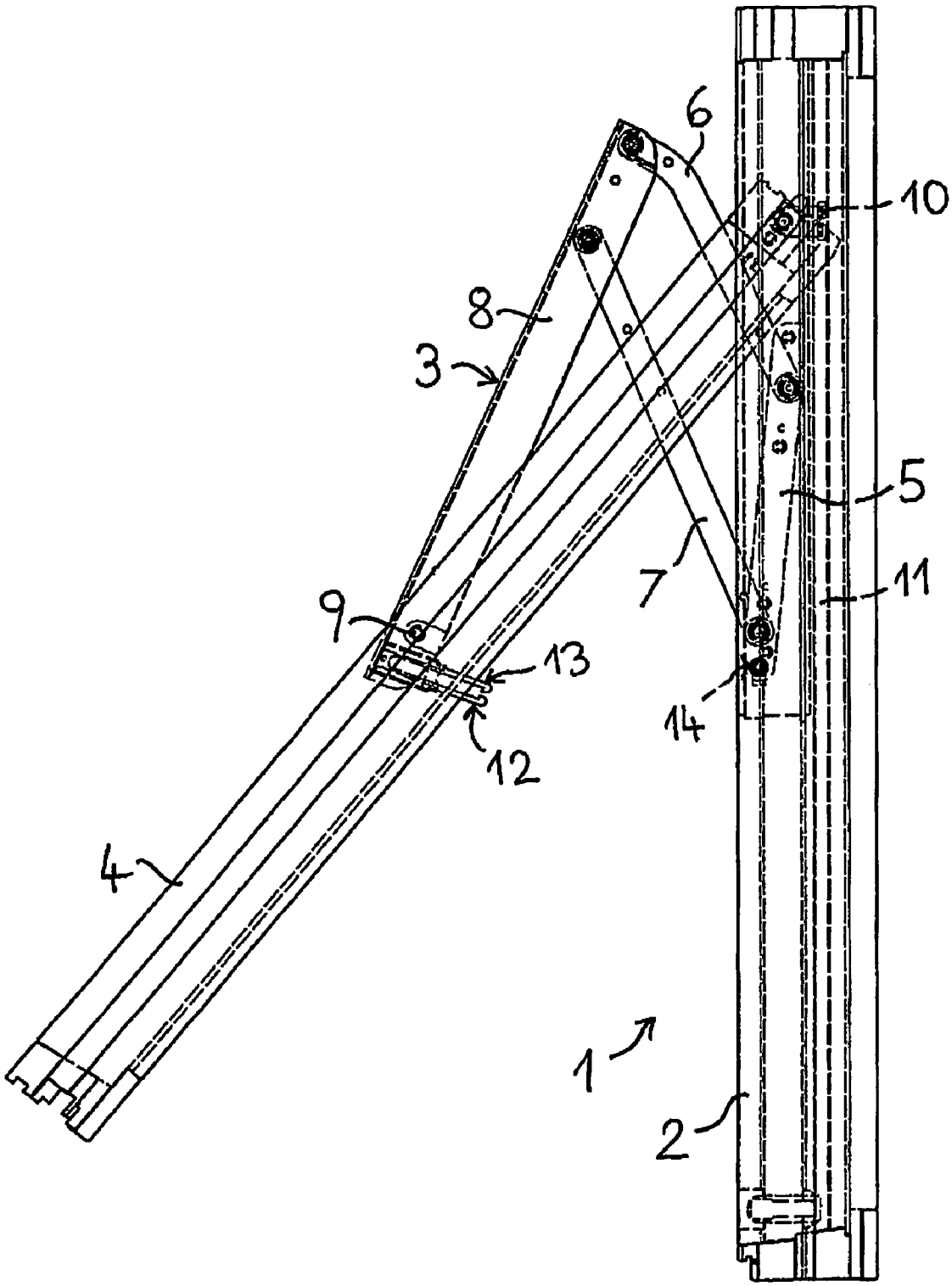
FIG. 3 the entire case and frame with the assembly according to FIG. 1, with the frame in a released higher opened up position.

FIG. 9 represents a swinging arm assembly position, in which the frame has been swung a larger distance outwards, roughly the distance shown in FIG. 3.

Figure 10:
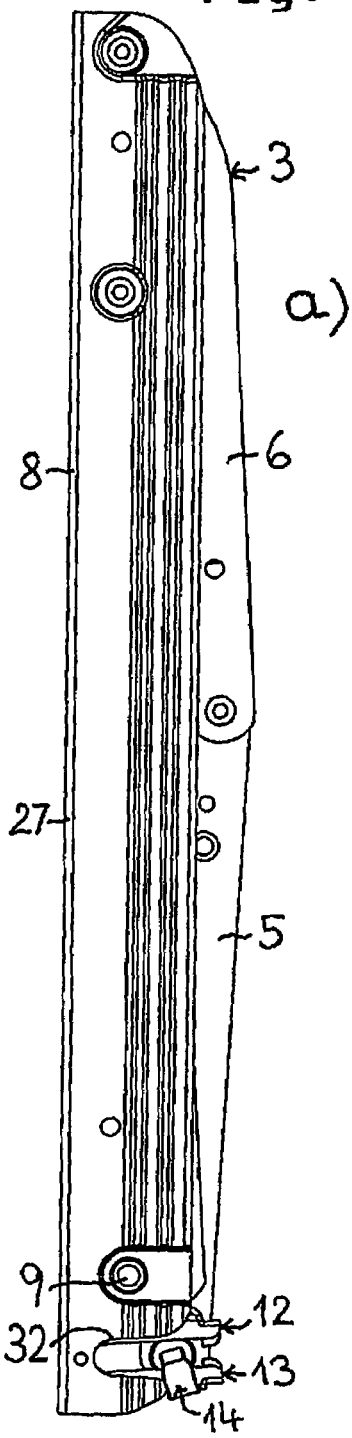
FIGS. 10*a* and *b* a lateral and an end view respectively of the assembly according to FIG. 4 in a closing phase between a ventilation position and a closing position.
Figure 12:
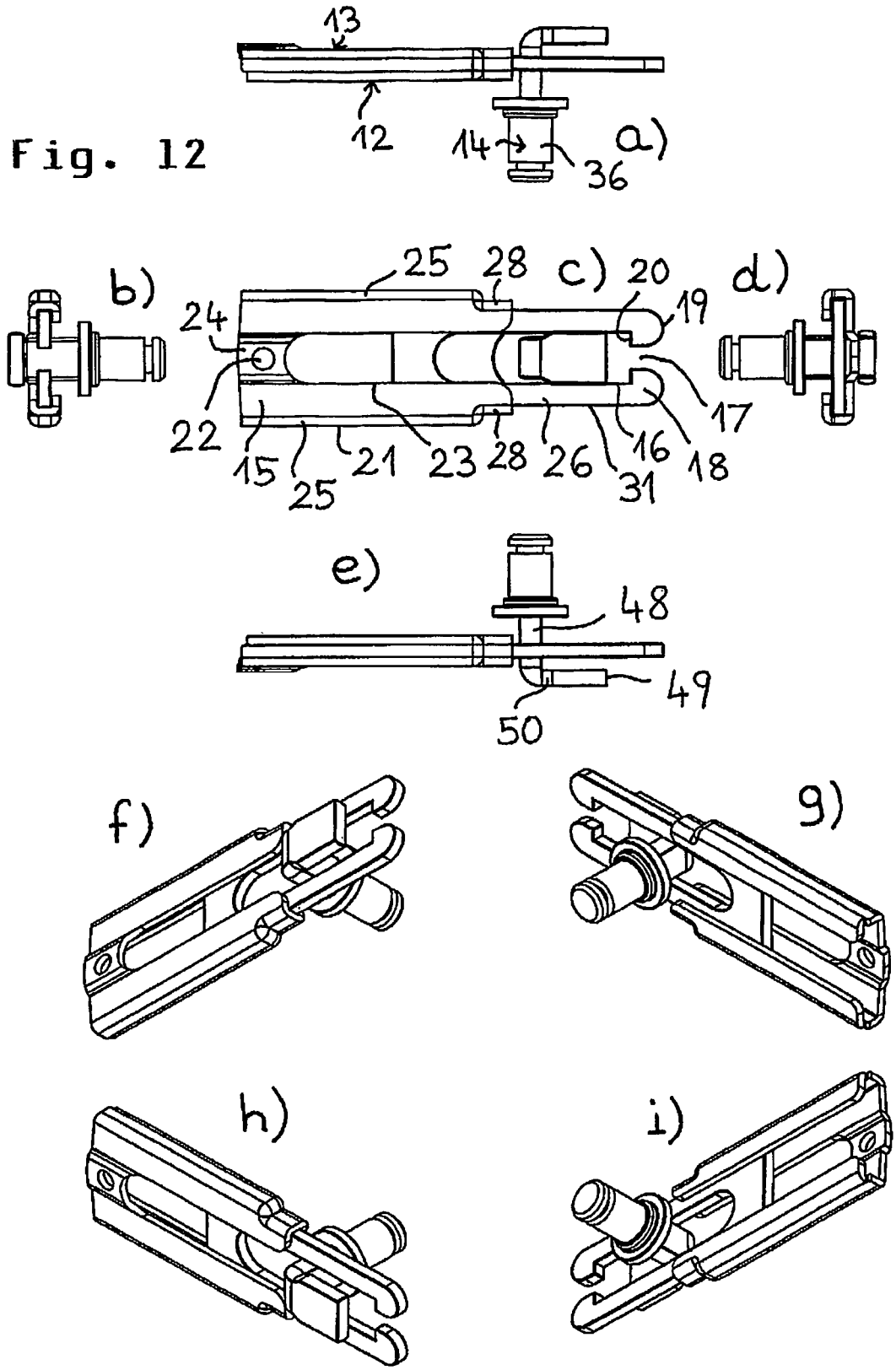
FIG. 12 views from different directions of central stop means parts of the assembly according to FIGS. 1-11 in a functional position between FIGS. 4 and 5.

According to FIG. 10 the frame and its frame plate have been swung back inside the ventilation position, the runner having been inserted and the plate-shaped portion having been passed by orifice 17. Towards the still mainly transversely extending guiding portion 49 the frame plate has started to abut one of its stop surfaces 51 and has consequently swung guiding portion 49 somewhat outwards in relation to the innermost portion of guiding groove 32.

Figure 11:
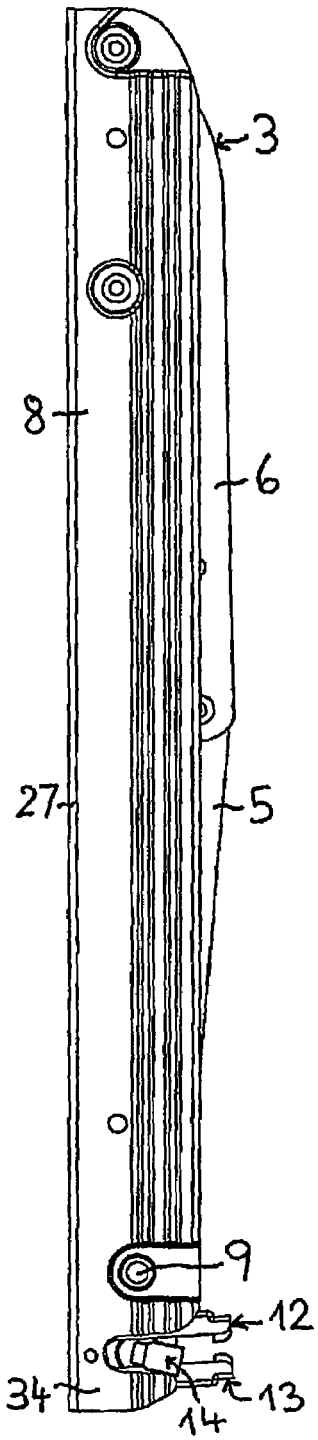
FIG. 11*a* a lateral view of the assembly according to FIG. 4 in a somewhat more advanced closing phase than the view shown in FIG. 10*a;*
Figure 11:
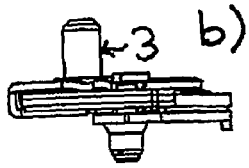

In FIG. 11 the movement, described right now, has continued and guiding portion 49 has a little more than half-ways entered guiding groove 32, additional swinging of the guiding portion having occurred, the plate-shaped portion almost completely having been placed cross-wise and consequently also in its stop position.

FIG. 4 represents the completed entering of the frame plate onto the guiding portion, its plate portion completely occupying a cross-wise position and consequently stopping a passage through the orifice without any previous manual swinging.

Figure 13:
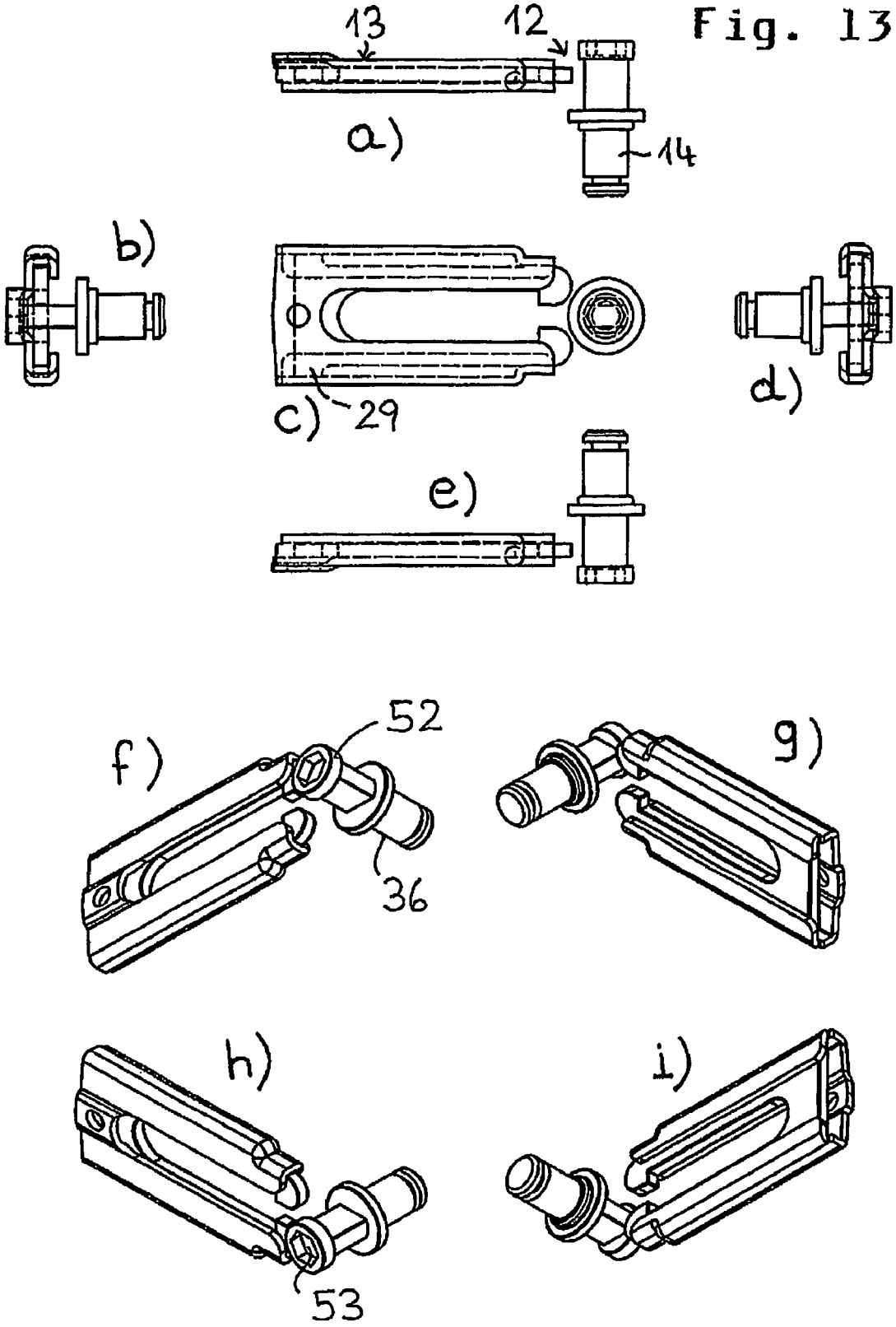
FIG. 13 the corresponding views to views in FIG. 12 of an alternative stop means design according to the invention.

FIG. 13 shows an alternative stop means part 14, in which however the section, which is to be anchored in the case plate, corresponds to e.g. FIG. 15. The section, which projects from the case plate, is, instead of an angled guiding portion, provided with an e.g. circular head 52 with a tool or key profiling 53, preferably an Allen screw, designed to receive an Allen key. This design will further render more difficult an unauthorized manipulation of the stop means.

Figure 16:
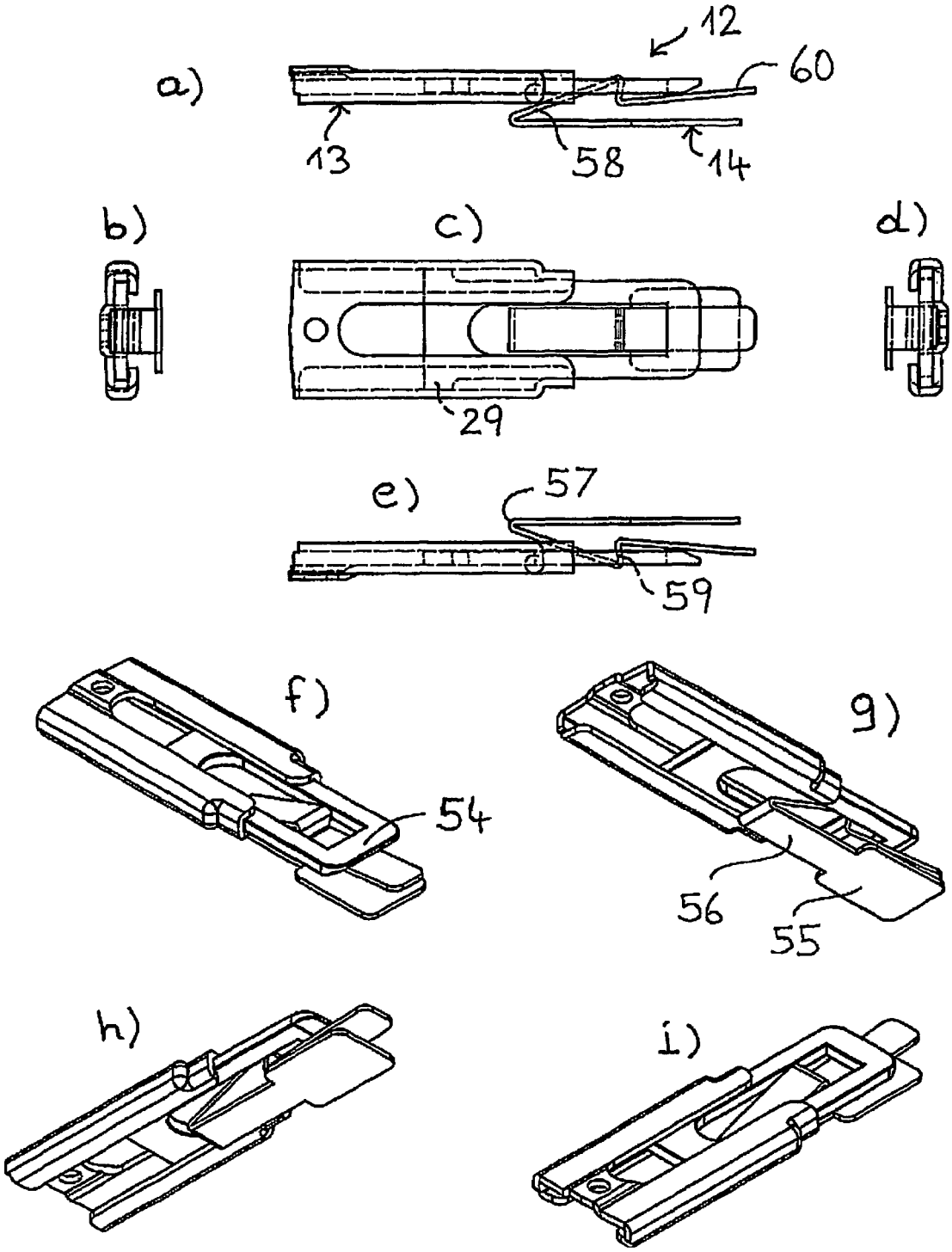
FIG. 16 views, which correspond to FIG. 12 of another modified stop means design according to the invention.

FIG. 16 shows an alternative stop means 12, in which a holder and a runner, guided in the holder, to a large extent corresponds to the embodiment shown and described above. However, the runner is closed at its front end by a cross bar 54. Stop means part 14 is designed with a base 55, attached to the case plate or the case side piece, from which base a tongue 56 extends towards stop means part 13. The tongue is at its end 57 facing away from the base, bent backwards with an angle of e.g. about 150°, with a section 58 in order to, roughly within the area of the tongue shoulder at the base, be bent towards the same to a stop element 59 and back again in roughly the same direction to a control end 60 with an angle, which is positioned between the base and section 58.

The position shown in FIG. 16 corresponds to an intermediate position between the closing position and the ventilation position. In case a person wants to close the window, the tongue with section 58 till be moved with sliding further into the guiding groove of the runner and the holder respectively. Cross bar 54 abuts some portion of the case side piece or the case plate and is pushed in this way all the way into the holder.

In case a person wants to open the window up to its ventilation position, then stop element 59 hits cross bar 54 and pulls the runner out of the holder, until the ears on the runner abut constriction section 28 of the holder. In case the person wants to open the window even more, then control end 60 will be pressed against the base, the stop element then not coming in contact with the cross bar.

In case a person wants to bring back the window to its ventilation position or closing position, then the slanting section 58, when the stop means parts are united, will hit the cross bar and be pushed by it towards the tongue shoulder, until the stop means has passed the cross bar and the tongue returns to its stop position due to its inherent elasticity.

In this embodiment stop means part 14 can be designed in many other ways than what has been shown and described respectively. It will be characterized in, that it is fastened to the case plate or the respective case side piece, in that it can be pushed inwards by a control end 60 to be released and in that it has a stop element 59. It might e.g. constitute a housing with a resilient button, which is provided with a control end and a stop element.

The present invention is not limited to the embodiments described above and shown in the drawings, but it can be modified and supplemented in an arbitrary manner within the scope of the inventive idea and the following claims.

The invention claimed is:

1. A window or a door (1), comprising a case (2) and a frame (4) pivotally fastened in the case by lateral swinging arm assemblies (3), each one of said assemblies having a base plate (5), fastened to a corresponding case side piece, to which base plate, at a top, one end of an upper swinging arm (6) and at a bottom and one end of a lower swinging arm (7) are articulately fastened, other ends of said arms being articulately fastened at a top of a frame plate (8), a lower end of which supports a swinging axle (9), to be inserted into the respective side piece of the frame, which is provided with upper lateral sliding mountings (10), which are guided in longitudinal grooves (11) in said case side pieces, releasable stop means (12) being mounted between the frame and the case and assembly parts, coordinated therewith respectively for a swinging limitation, which can be cancelled, of the frame in relation to the case, the lower frame end being provided with locking means for locking the frame to the case, and said stop means (12) are positioned on that side of the frame, which is turned away from said swinging arms (6; 7), a first stop means part (13) at or adjacent the lower end of said frame plate (8) and a second stop means part (14) at or adjacent the lower end of said base plate (5), and at least one of said stop means parts is respectively telescoped outward and inward and thus is made longer and shorter respectively;

wherein stop action of said stop means (12) is cancelled through a manual friction controlled swinging of one of said stop means parts (14) into a free position, which is, by guiding means (32), at an other one of said stop means parts independently changed into a stop position in a final phase of closing of the frame (4).

2. The window or the door according to claim 1, wherein the frame plate (8) supports, with a portion (34) that extends downwardly beyond the swinging axle (9), said first stop means part (13) and is a portion of the same, said first stop means part (13) is a guiding groove (16), open in relation to the second stop means part (14), an orifice (17) of which is constricted by claws (18), facing each other, an outer side of the claws forms guiding surfaces (19) for said second stop means part (14) and are designed as bends, whereas interior sides (20) of the claws mainly are at right angles in relation to the guiding groove to form a stop means for said second stop means part (14), the guiding groove (16) is positioned within a plane of the frame plate or within a plane that is parallel with the frame plate, said first stop means part (13) is positioned at least mainly within a plane of the swinging arms, and said second stop means part (14) is positioned mainly within the plane of the swinging arms and the frame plate (8).

3. The window or the door according to claim 1, wherein the first stop means part (13) is telescopically designed to increase in active length, which is accomplished by using a holding element (21), which has a C—profile—shape and is provided with a web (15), to be fastened to a side of the frame plate, which faces the base plate (5), or to the respective case side piece, the web houses a guiding groove (23) and is at least mainly congruent with said guiding groove in a closing position of the assembly, and thus is split in addition to a section (24), which is positioned at a far end from said second stop means part (14) and is a fastening zone, grooved longitudinal sides (25) of the holding element (21) are designed to hold and guide a runner (26) which, in an inserted position, at a far end, abuts a lug (27), angled from the frame plate (8) towards the adjacent case side piece, and the runner in an other direction is stopped from being drawn out of the holding element by stop elements, towards sections (28) of said grooved longitudinal sides, which are pressed against each other and designed to stop displacement of the runner towards said second stop means part (14), by providing the runner with ears (29), that are guided in the grooved-longitudinal sides (25) and projecting in mutually opposite directions, the ears are designed to abut the sections (28) in the position of the runner when the is maximally drawn out, the runner has a plated form with a guiding groove, claws facing each other and a section, positioned at a far end from the second stop means part, from which section said ears project, the longitudinal sides (31) of the runner are guided solely or mainly by said section (28), forming a constriction, and the frame plate is provided with a guiding groove (32), which is congruent in relation to the guiding groove of the holding element and the runner.

4. The window or the door according to claim 1, wherein the second stop means part (14) comprises a pivot (36), which is mounted in the base plate extension in a stationary housing (37), which extends through said base plate extension and projects a short distance from a case side of the extension, to be, with the second step means part, which is projecting from the case side of the extension, inserted and fastened by a press fit, into a blind hole in the case, the pivot is friction-controlled and protected against withdrawal after being inserted into the blind hole, by providing at least the housing and the pivot with one or several grooves (38, 39 and 40 respectively), housing an O-ring (41) and a circlip (42) respectively.

5. The window or the door according to claim 4, wherein the housing and the pivot are provided in grooves (35 and 40 respectively), facing each other, in a rivet base (30) and a housing base (46) respectively, with the circlip (42), whereas an other groove (38) in the rivet base is provided with the O-ring 41, compressed by the groove and the housing to generate friction, and the housing is anchored to material around a bore (43) in the extension of the base plate.

6. The window or the door according to claim 4, wherein a rivet base (30) projects above an end of the housing, turned away from the extension and has a groove (39) for the circlip (42), a rivet at an other end has a flange (44), between the flange and the rivet body, which is cylindrical, a bevel (45) in the housing, the O-ring (41) being inserted under compression causes friction-generation, and the housing is somewhat shorter and is obtained by material from the extension, an annular groove (47) is made to receive the flange (44).

7. The window or the door according to claim 2, wherein from a rivet body, towards said first stop means part (13), a stop element (48) projects and has multiple functions, a shoulder part of the stop element in a certain angular position has a blocking function and in another position, which is one of 90 ° clockwise or counter-clockwise in relation to said angular position, a release function, by forming the shoulder part as a plate, having a width of its cross section being twice as large as a thickness thereof, the thickness of the plate passes between claws (18), but not the width of the plate, which mainly fills a width of the groove and during displacement biases a runner, which abuts interior sides (20) of the grooves, a guiding portion (49) of the stop element is bent at right angles, in relation to the shoulder part, around one of said broad interior sides and is designed as a lug, which projects in one direction, with sides (50), which diverge from the shoulder part to facilitate steering, and a guiding groove (32) of the frame plate diverges outwards, at least within an area of the orifice, which is designed with softly rounded stop surfaces (51), and the guiding portion (49) is wider than the guiding groove (16), the guiding portion not being able to pass cross wise through the guiding groove.

8. The window or the door according to claim 1, wherein the second stop means part (14) has a section, which projects from the base plate, and comprises a circular head (52) having a tool or key profiling (53), with an Allen key opening, designed to receive an Allen key.

9. The window the door according to claim 1, wherein the stop means (12) comprises a holder and a runner, which is guided in the holder, the runner is closed at a front end by a cross bar (54), said second stop means part (14) is designed with a base (55), fastened to the base plate or the case side piece and from which a tongue (56) projects towards said first stop means part (13), the tongue has an end (57) turned away from the base and is bent rearwards with an angle of about 150° with a section (58), to be bent, roughly within an area of a tongue shoulder at the base, towards the base to obtain a stop element (59), and back again roughly in a same direction to a control end (60) with an angle between the base and said section (58).

* * * * *